US011554412B2

(12) United States Patent
Asaoka et al.

(10) Patent No.: US 11,554,412 B2
(45) Date of Patent: Jan. 17, 2023

(54) MOLD PROCESSING SYSTEM AND MOLD PROCESSING METHOD

(71) Applicant: SINTOKOGIO, LTD., Nagoya (JP)

(72) Inventors: Yasuaki Asaoka, Nagoya (JP); Kazunori Ogura, Nagoya (JP); Toshiyuki Ishikawa, Nagoya (JP); Takehiro Sugino, Nagoya (JP)

(73) Assignee: SINTOKOGIO, LTD., Nagoya (JP)

( * ) Notice: Subject to any disclaimer, the term of this patent is extended or adjusted under 35 U.S.C. 154(b) by 0 days.

(21) Appl. No.: 17/360,005

(22) Filed: Jun. 28, 2021

(65) Prior Publication Data

US 2022/0001440 A1 Jan. 6, 2022

(30) Foreign Application Priority Data

Jul. 1, 2020 (JP) ..... JP2020-114156

(51) Int. Cl.
*B22C 19/04* (2006.01)
*B22C 9/06* (2006.01)
*B22C 9/18* (2006.01)

(52) U.S. Cl.
CPC ..... *B22C 19/04* (2013.01); *B22C 9/067* (2013.01); *B22C 9/18* (2013.01)

(58) Field of Classification Search
CPC ..... B22C 19/04; B22C 9/067; B22C 11/00; B22C 11/02; B22C 11/08; B22C 11/12; B22C 25/00; B22C 9/18
See application file for complete search history.

(56) References Cited

FOREIGN PATENT DOCUMENTS

JP 2020-011245 A 1/2020
WO WO-2019145975 A1 * 8/2019

* cited by examiner

*Primary Examiner* — Kevin P Kerns
*Assistant Examiner* — Steven S Ha
(74) *Attorney, Agent, or Firm* — Faegre Drinker Biddle & Reath LLP

(57) ABSTRACT

A mold processing system includes a conveyance line intermittently conveying a mold with a predetermined standstill time, a processing apparatus, a conveyance apparatus conveying the processing apparatus along the conveyance line, and a control unit, wherein the control unit controls the conveyance apparatus to set the processing apparatus at a position corresponding to a first position on the conveyance line and controls the processing apparatus to perform a part of the process on the mold conveyed to the first position, and the control unit controls, after completion of the part of the process, the conveyance apparatus to move the processing apparatus to a position corresponding to a second position and controls the processing apparatus to perform the rest of the process within the standstill time.

7 Claims, 14 Drawing Sheets

MOLD PROCESSING SYSTEM AND MOLD PROCESSING METHOD

CROSS-REFERENCE TO RELATED APPLICATION

This application is based on Japanese Patent Application No. 2020-114156 filed with Japan Patent Office on Jul. 1, 2020, the entire contents of which are hereby incorporated by reference.

TECHNICAL FIELD

The present disclosure relates to a mold processing system and a mold processing method.

BACKGROUND

Japanese Unexamined Patent Publication No. 2020-11245 discloses a molding apparatus including mold conveyance means and an identification marking forming tool. The molding apparatus presses the identification marking forming tool against molds sequentially conveyed by the mold conveyance means to form identification markings on the molds.

SUMMARY

It can be considered that, in a conveyance line which intermittently conveys molds with a predetermined standstill time, a process is performed on the conveyed molds on the line. In this case, in order to perform the process without affecting the conveyance, it is necessary to complete the process within the predetermined standstill time. In a case where a processing apparatus cannot perform the process within the predetermined standstill time, it can be considered that a plurality of processing apparatuses are arranged along the conveyance line and each processing apparatus shares the process. However, this makes the structure complicated. The present disclosure provides a technique for performing a process on a mold with a simple configuration without affecting the conveyance of the mold.

A mold processing system according to one aspect of the present disclosure includes: a conveyance line intermittently conveying a mold with a predetermined standstill time; a processing apparatus performing a process on the mold on the conveyance line; a conveyance apparatus conveying the processing apparatus along the conveyance line; and a control unit controlling the processing apparatus and the conveyance apparatus. The control unit controls the conveyance apparatus to set the processing apparatus at a position corresponding to a first position on the conveyance line and controls the processing apparatus to perform a part of the process on the mold conveyed to the first position within the standstill time from the timing when the mold is conveyed to the first position. The control unit controls, after completion of the part of the process, the conveyance apparatus to move the processing apparatus to a position corresponding to a second position downstream of the first position on the conveyance line and controls the processing apparatus to perform the rest of the process on the mold subjected to the part of the process and conveyed to the second position within the standstill time from the timing when the mold subjected to the part of the process is conveyed to the second position.

In the mold processing system, the mold is intermittently conveyed on the conveyance line with the predetermined standstill time. The processing apparatus which performs a process on the mold is set by the conveyance apparatus at the position corresponding to the first position on the conveyance line. When the mold is conveyed to the first position, a part of the process is performed by the processing apparatus on the mold conveyed to the first position within the standstill time from the timing when the mold is conveyed to the first position. After completion of the part of the process, the processing apparatus is moved by the conveyance apparatus to the position corresponding to the second position on the conveyance line. When the mold is conveyed to the second position, the rest of the process is performed by the processing apparatus on the mold which has been subjected to the part of the process within the standstill time from the timing when the mold is conveyed to the second position. In this manner, the processing apparatus can move together with the mold and continuously perform the process which cannot be completed while the mold is positioned at the first position after the mold is moved to the second position located downstream. That is, even when the process requires a time longer than the standstill time, the mold processing system can avoid extension of the standstill time by performing the process in a divided manner. Moreover, in the mold processing system, since the processing apparatus moves together with the mold, it is not necessary to prepare a plurality of processing apparatuses. Thus, the mold processing system can perform the process on the mold with a simple configuration without affecting the conveyance of the mold.

In one embodiment, the processing apparatus may be a marking apparatus marking an identifier on the mold.

In one embodiment, the processing apparatus may be a gas vent forming apparatus forming a gas vent hole on the mold.

In one embodiment, the first position and the second position may be adjacent to each other, the conveyance line may convey a plurality of molds, the plurality of molds may include a first mold to be subjected to the process and a second mold not to be subjected to the process, the conveyance line may alternately and sequentially convey the first mold and the second mold, and the control unit may control, after completion of the rest of the process on the first mold, the conveyance line to return the processing apparatus to the position corresponding to the first position to perform the part of the process on the first mold conveyed to the first position next. Since the first mold and the second mold are alternately and sequentially conveyed, the second mold is set at the first position after the first mold is set, and the first mold is set at the second position after the second mold is set. That is, the first molds are not simultaneously set at the first position and the second position. Thus, the processing apparatus can perform the process on each of the first molds sequentially conveyed merely by moving back and forth between the position corresponding to the first position and the position corresponding to the second position.

A mold processing method according to another aspect of the present disclosure is a mold processing method performed by a mold processing system. The mold processing system includes: a conveyance line intermittently conveying a mold with a predetermined standstill time; a processing apparatus performing a process on the mold on the conveyance line; and a conveyance apparatus conveying the processing apparatus along the conveyance line. The mold processing method includes: a step of setting, by the conveyance apparatus, the processing apparatus at a position corresponding to a first position; a step of performing, by the processing apparatus, a part of the process on the mold conveyed to the first position within the standstill time from the timing when the mold is conveyed to the first position; a step of moving, by the conveyance apparatus, the processing apparatus to a position corresponding to a second position downstream of the first position on the conveyance line after completion of the part of the process; and a step of performing, by the processing apparatus, the rest of the process on the mold subjected to the part of the process and conveyed to the second position within the standstill time from the timing when the mold subjected to the part of the process is conveyed to the second position.

In the mold processing method, the mold is intermittently conveyed on the conveyance line with the predetermined standstill time. The processing apparatus which performs a process on the mold is set by the conveyance apparatus at the position corresponding to the first position on the conveyance line. When the mold is conveyed to the first position, a part of the process is performed by the processing apparatus on the mold conveyed to the first position within the standstill time from the timing when the mold is conveyed to the first position. After completion of the part of the process, the processing apparatus is moved by the conveyance apparatus to the position corresponding to the second position on the conveyance line. When the mold is conveyed to the second position, the rest of the process is performed by the processing apparatus on the mold which has been conveyed to the first position and subjected to the part of the process within the standstill time from the timing when the mold is conveyed to the second position. In this manner, the processing apparatus can move together with the mold and continuously perform the process which cannot be completed while the mold is at a standstill at the first position after the mold is moved to the second position located downstream. That is, even when the process requires a time longer than the standstill time, the mold processing system can avoid extension of the standstill time by performing the process in a divided manner. Moreover, in the mold processing system, since the processing apparatus moves together with the mold, it is not necessary to prepare a plurality of processing apparatuses. Thus, the mold processing method performed by the mold processing system can perform the process on the mold with a simple configuration without affecting the conveyance of the mold.

The present disclosure provides a technique for performing a process on a mold with a simple configuration without affecting the conveyance of the mold.

DETAILED DESCRIPTION

Figure 1:
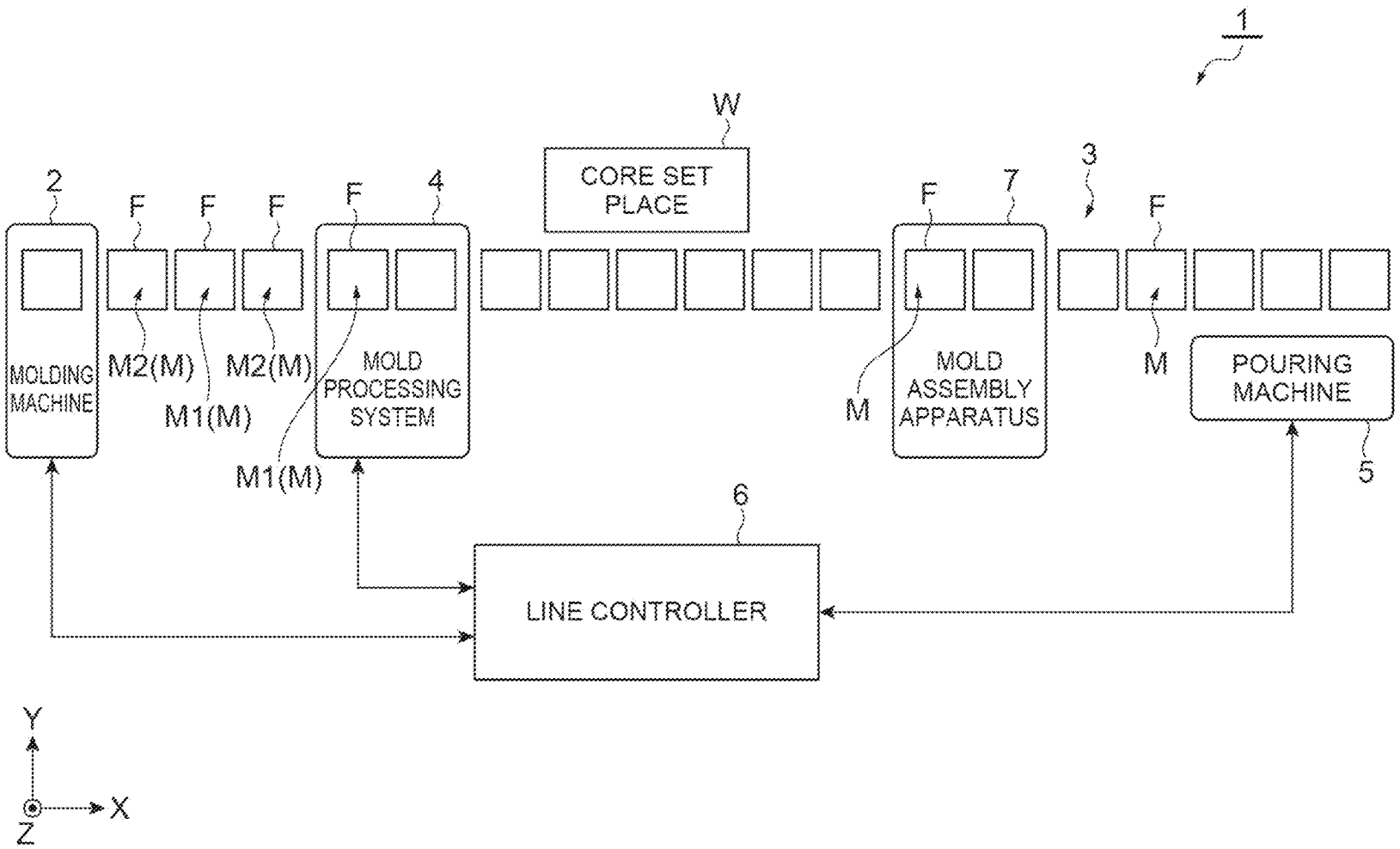
FIG. 1 is a configuration diagram schematically illustrating an example of a casting system according to an embodiment.

Hereinbelow, an embodiment of the present disclosure will be described with reference to the drawings. Note that, in the following description, identical reference signs designate identical or corresponding elements to omit redundant description. The dimensional ratio in the drawings does not necessarily coincide with an actual ratio. The "up", "down", "left" and "right" are based on an illustrated state and used for convenience sake.

Example of Casting System

FIG. 1 is a configuration diagram schematically illustrating an example of a part of a casting system including a mold processing system according to an embodiment. A casting system 1 illustrated in FIG. 1 is a system for manufacturing casts. The casting system 1 includes a molding machine 2, a conveyance line 3, a mold processing system 4, a pouring machine 5, a line controller 6, and a mold assembly apparatus 7. In the drawings, an X direction and a Y direction correspond to a horizontal direction, and a Z direction corresponds to a vertical direction. The X, Y, and Z directions are axial directions perpendicular to each other in a rectangular coordinate system in a three-dimensional space.

The molding machine 2 is a machine which manufactures a mold M. The molding machine 2 forms the mold M using a molding flask F. The molding machine 2 is communicably connected to the line controller 6. When receiving a molding start signal from the line controller 6, the molding machine 2 starts manufacturing the mold M in a molding area. The molding machine 2 charges sand (casting sand) into the molding flask F in which a pattern as a model of a product is set and compacts the sand inside the molding flask F by applying pressure to the sand. The molding machine 2 forms the mold M by taking the pattern out of the compacted sand. The mold M includes a cope M1 and a drag M2 which are paired. Pouring is performed with the cope M1 and the drag M2 mold-assembled with each other. The molding machine 2 transmits a molding result signal to the line controller 6.

The molding result signal is a signal indicating whether the molding machine 2 has normally operated.

The conveyance line 3 is a facility which conveys the mold from upstream to downstream. The conveyance line 3 receives the mold M from the molding machine 2 and conveys the mold M to the pouring machine 5 located downstream. For example, the conveyance line 3 alternately conveys the copes M1 and the drags M2. The conveyance line 3 may include, for example, a roller conveyor, a rail, a carriage which travels on the rail with the mold M (the cope M1 or the drag M2) and the molding flask F placed thereon, a pusher device which is disposed at the molding machine 2 side, and a cushion device which is disposed at the pouring machine 5 side. In a case where the conveyance line 3 includes a roller conveyor, the molding flask F is provided with a roller traveling surface. The roller conveyor or the rail linearly extends from the molding machine 2 to the pouring machine 5. The roller conveyor or the rail may extend not linearly, but, for example, in a step-like manner The roller conveyor or the rail may extend in a single stroke manner between the molding machine 2 and the pouring machine 5. The conveyance line 3 sequentially conveys a plurality of molds M and molding flasks F, which are arrayed at regular intervals on the roller conveyor or the rail, from the molding machine 2 to the pouring machine 5. The conveyance line 3 is intermittently driven and conveys the molds M and molding flasks F by a predetermined number of flasks at each drive. The predetermined number of molding flasks may be one molding flask or may be a plurality of molding flasks. The conveyance line 3 is communicably connected to the line controller 6. When receiving a flask feeding signal from the line controller 6, the conveyance line 3 conveys the plurality of molds M and molding flasks F by the predetermined number of flasks. Upon completion of the conveyance of the predetermined number of flasks, the conveyance line 3 transmits a flask feeding completion signal to the line controller 6. The conveyance line 3 may transmit the flask feeding completion signal to the line controller 6 when positioning of the conveyed molds M and molding flasks F is completed.

The mold processing system 4 is provided on the conveyance line 3 and performs a process on the mold M on the conveyance line 3. Examples of the process include processing, addition, and measurement. The mold processing system 4 can be communicably connected to the line controller 6. The mold processing system 4, the conveyance line 3, and the line controller 6 may operate in cooperation with each other. For example, the mold processing system 4 may include a processing apparatus 10 such as a marking apparatus, a sprue forming apparatus, a gas vent forming apparatus, a sand cut apparatus, a mold seal construction apparatus, a core set apparatus, a mold coating apparatus, a mold strength measuring apparatus, or a mold dimension measuring apparatus. The marking apparatus may include a laser marking apparatus, a stamping type marking apparatus, or a cutting type marking apparatus. Details of the mold processing system 4 will be described later.

In a case where the mold processing system 4 is not a core set apparatus, a core set place W may be provided between the molding machine 2 and the pouring machine 5. An operator stays in the core set place W and sets a core in the mold M. Alternatively, a core set apparatus may automatically set the core in the mold M. The pair of cope M1 and drag M2 are mold-assembled with each other by the mold assembly apparatus 7 after the core is set.

The pouring machine 5 is a machine which pours molten metal into the mold M. The pouring machine 5 is communicably connected to the line controller 6. When receiving the flask feeding completion signal from the line controller 6, the pouring machine 5 pours molten metal into the mold-assembled mold M located in a pouring area as a pouring target. The pouring machine 5 receives mold information from the line controller 6 and pours molten metal under a condition based on the mold information. Examples of the mold information include a product weight, a casting weight, and product identifying information. The product identifying information is, for example, a pattern number, a product type, information indicating the presence or absence of a mold defect, or information indicating the type of mold defect. The mold M with molten metal is conveyed to an area where a downstream process is performed through the conveyance line 3.

The line controller 6 is a controller which performs centralized control of the casting system 1. The line controller 6 is configured as, for example, a programmable logic controller (PLC). The line controller 6 may be configured as a computer system including a processor, such as a central processing unit (CPU), a memory, such as a random access memory (RAM) and a read only memory (ROM), an input/output device, such as a touch panel, a mouse, a keyboard, or a display, and a communication device, such as a network card. The line controller 6 implements the function of the line controller 6 by operating each hardware under control of the processor based on a computer program stored in the memory.

The line controller 6 controls the conveyance line 3 to intermittently convey the molds M with a predetermined standstill time. The standstill time is a time during which the molds M are at a standstill on the conveyance line 3 and previously determined in such a manner that the standstill time and a time during which the molds M move become alternate. For example, the conveyance line 3 conveys the molds M on the roller conveyor downstream by one flask and brings the molds M to a standstill. After the elapse of the predetermined standstill time, the conveyance line 3 conveys the molds M on the roller conveyor downstream by one flask and brings the molds M to a standstill. The conveyance line 3 repeatedly performs the conveyance and stopping of the molds M on the basis of the predetermined standstill time.

Details of Mold Processing Apparatus

Figure 2:
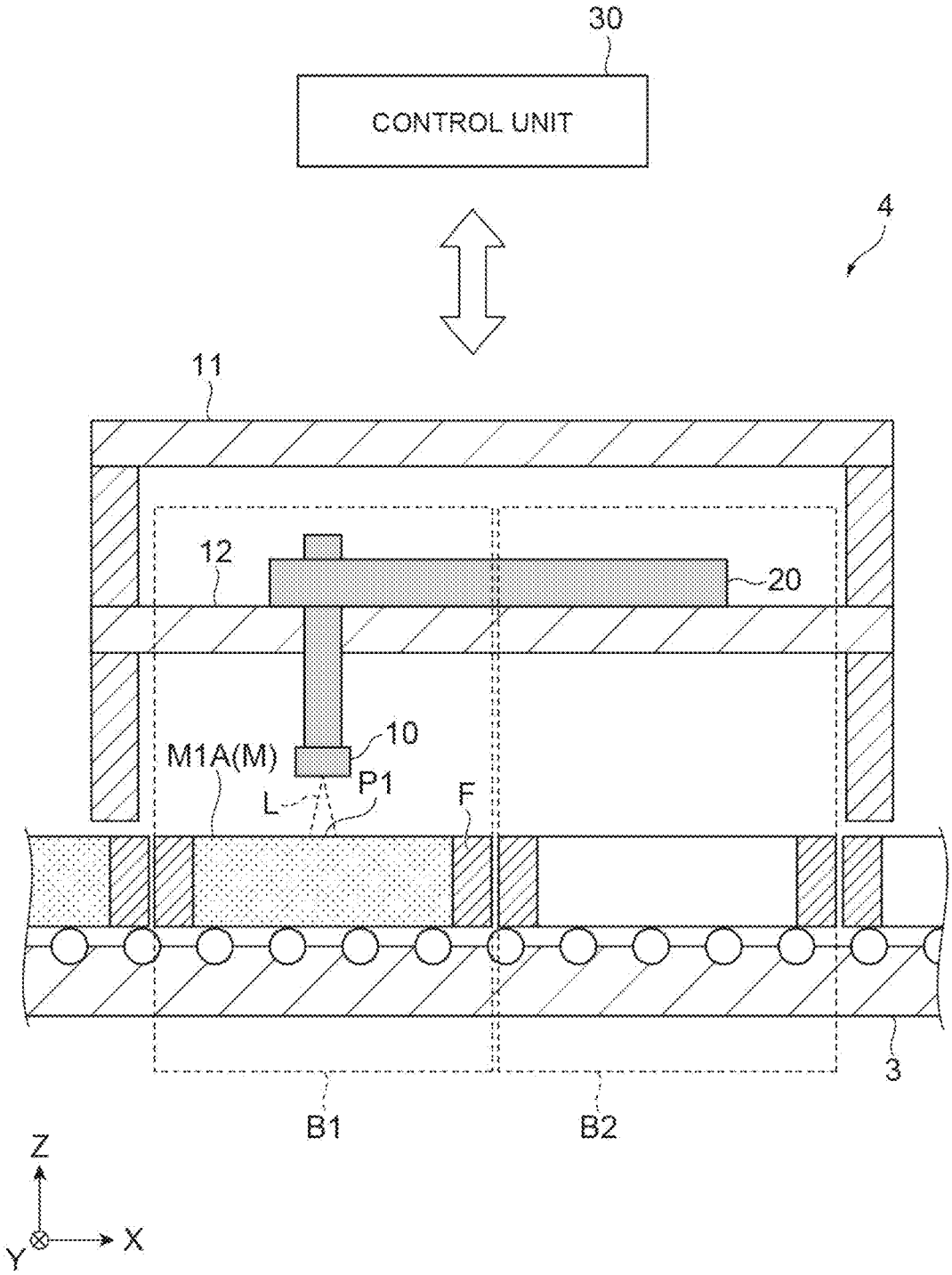
FIG. 2 is a sectional view of a mold processing system, illustrating an example in which a processing apparatus set at a first position performs a process on a mold.

FIG. 2 is a sectional view of the mold processing system, illustrating an example in which the processing apparatus set at a first position performs the process on the mold. The mold processing system 4 includes the conveyance line 3, the processing apparatus 10, a conveyance apparatus 20, and a control unit 30. As an example of the conveyance of the molds M, the conveyance line 3 alternately conveys copes M1A and drags M2A.

The processing apparatus 10 performs the process on the mold M on the conveyance line 3. A case where the processing apparatus 10 is a laser marking apparatus will be described as an example. The processing apparatus 10 marks an identifier on the mold M by applying laser light L to the mold M. The identifier is a character, a number, or a symbol imparted to an object, and to mark means to place the character, the number, or the symbol on the mold. Hereinbelow, a marking process for performing marking on the cope M1A (an example of the first mold) will be described as an example of the process performed by the processing apparatus 10.

The processing apparatus 10 focuses the laser light L at an intended marking point. The processing apparatus 10 includes a light source (not illustrated) which generates laser light. For example, the processing apparatus 10 includes a galvanometer mirror (not illustrated) and a focusing lens (not illustrated) and adjusts an irradiation position and a focal length of the laser light L. The processing apparatus 10 focuses the focal length of the laser light L at an intended processing position P1 on the surface of the cope M1A to mark the identifier. The intended processing position P1 is set within a predetermined range on the cope M1A.

The processing apparatus 10 is disposed corresponding to the position of the cope M1A standing still on the conveyance line 3. For example, in FIG. 2, the processing apparatus 10 is disposed in such a manner as to be located above the cope M1A. The processing apparatus 10 performs the process toward the intended processing position P1 set on the upper face of the cope M1A. The processing apparatus 10 may be disposed in such a manner as to be located below the conveyance line 3. In this case, the processing apparatus 10 performs the process toward an intended processing position set on the lower face of the cope M1A.

The conveyance apparatus 20 conveys the processing apparatus 10 along the conveyance line 3. For example, the conveyance apparatus 20 is a three-axis robot provided on a frame member 12 inside a case 11. In a case where the processing apparatus 10 is disposed above the conveyance line 3, the conveyance apparatus 20 is provided above the processing apparatus 10 and supports the processing apparatus 10 in a conveyable manner. When the processing apparatus 10 performs the process, the conveyance apparatus 20 may adjust the position of the processing apparatus 10. For example, the conveyance apparatus 20 may adjust the position of the processing apparatus 10 in the X direction, the Y direction, and the Z direction so that the processing apparatus 10 is located immediately above the intended processing position P1. In a case where the processing apparatus 10 is disposed below the conveyance line 3, the conveyance apparatus 20 may be provided below the processing apparatus 10.

The control unit 30 controls the processing apparatus 10 and the conveyance apparatus 20. The controlling means determining position and operation. The control unit 30 is configured as, for example, a PLC. The control unit 30 may be configured as the computer system described above. The control unit 30 may be disposed outside the case 11 or may be disposed inside the case 11. The control unit 30 may be communicably connected to the line controller 6.

A position where the mold M comes to a standstill is set on the conveyance line 3. For example, in FIG. 2, a first position B1 and a second position B2 are set inside the case 11. The first position B1 is set upstream of the second position B2, and the second position B2 is set downstream of the first position B1. The first position B1 and the second position B2 are adjacent to each other. The mold M conveyed from upstream on the conveyance line 3 comes to a standstill at the first position B1.

The control unit 30 controls the conveyance apparatus 20 to set the processing apparatus 10 at a position corresponding to the first position B1. The position corresponding to the first position B1 is a position where the processing apparatus 10 can perform the process on the cope M1A conveyed to the first position B1. The control unit 30 causes the processing apparatus 10 to start the process at the timing when the processing apparatus 10 is set at the position corresponding to the first position B1 and the cope M1A is conveyed to the first position B1. The control unit 30 may detect that the cope M1A and the processing apparatus 10 have been set using, for example, a detector (not illustrated).

The processing apparatus 10 performs a part of the process on the cope M1A at the first position B1 within the standstill time. The process is previously set for the cope M1A, and the part of the process is a partial step included in the process. For example, in a case where the cope M1A is provided with two product parts, and it is previously set that each of the two product parts is processed for the cope M1A, a process on one of the product parts corresponds to the part of the process. The product part refers to a part to which the product shape is transferred from the pattern. The part of the process is set in such a manner as to be completed within the standstill time during which the cope M1A is at a standstill at the first position B1. In other words, the process set for the cope M1A is divided into a plurality of processes each of which can be completed within the standstill time. The control unit 30 conveys the processing apparatus 10 to the second position B2 located downstream in response to completion of the part of the process.

Figure 3:
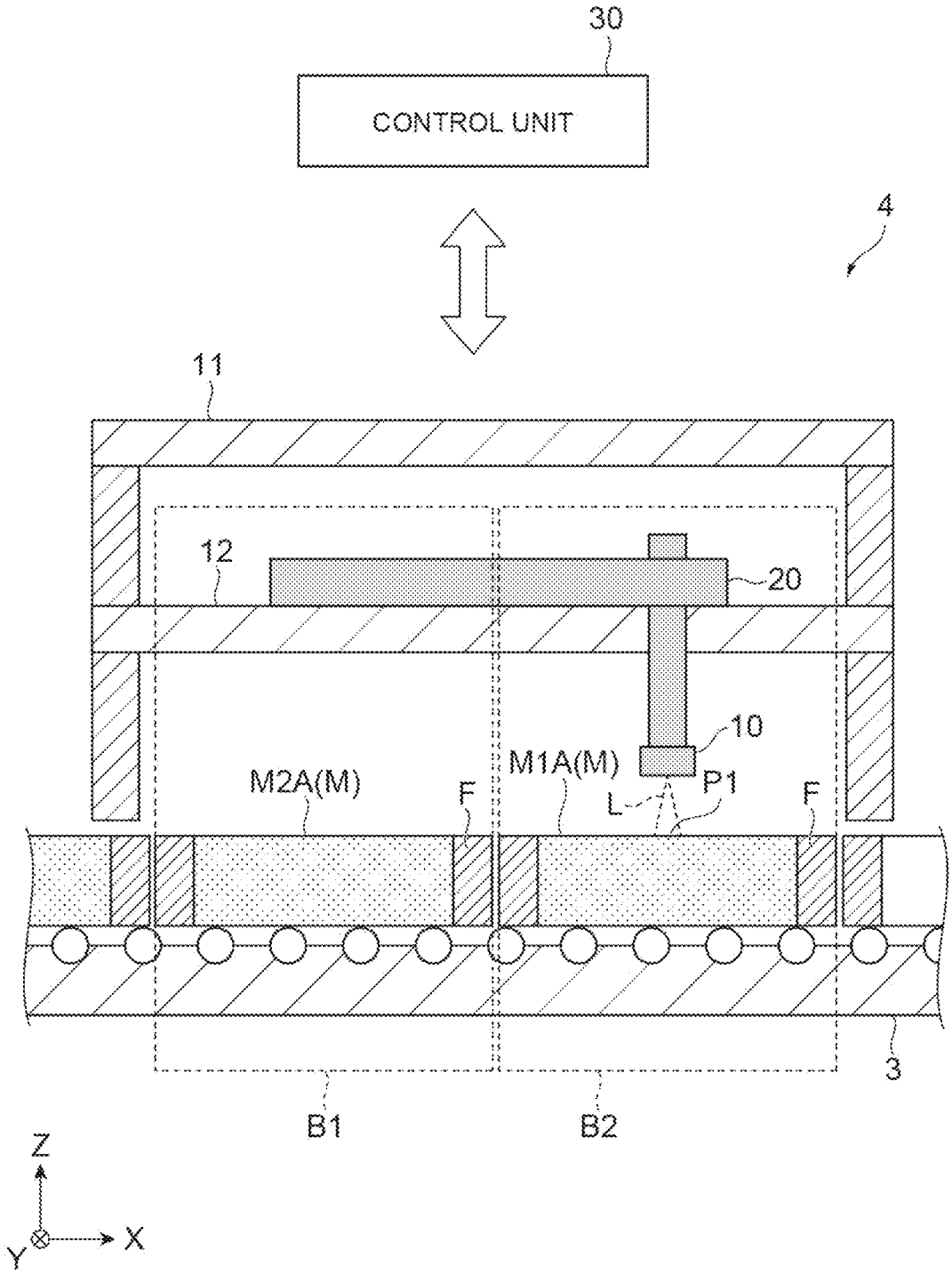
FIG. 3 is a sectional view of the mold processing system, illustrating an example in which the processing apparatus moved to a second position performs the process on the mold.

FIG. 3 is a sectional view illustrating an example in which the mold processing system coveys the processing apparatus downstream and performs the process. The conveyance line 3 simultaneously conveys the molds M on the roller conveyor by one flask after the elapse of the predetermined standstill time. The cope M1A is conveyed from the first position B1 to the second position B2. The drag M2A (an example of the second mold) which is paired with the cope M1A is conveyed from upstream to the first position. The drag M2A does not have the intended processing position P1. Thus, the process is not performed by the processing apparatus 10 on the drag M2A.

The control unit 30 causes the processing apparatus 10 to start the process at the timing when the processing apparatus 10 is set at a position corresponding to the second position B2, and the cope M1A is conveyed to the second position B2. The state where the cope M1A and the processing apparatus 10 are set at the second position B2 refers to a state where the cope M1A is at a standstill at a predetermined position within the second position B2, and the processing apparatus 10 has been conveyed to a position where the process can be performed on the cope M1A at a standstill. The control unit 30 may detect that the cope M1A and the processing apparatus 10 have been set using, for example, a detector (not illustrated).

The processing apparatus 10 performs the rest of the process on the cope M1A at the second position B2 within the standstill time. The rest of the process is a process left by eliminating at least the part of the process described above from the process previously set for the cope M1A. For example, when the process has been performed on one of the two product parts provided on the cope M1A at the first position B1 as described above, a process to be performed on the other of the two product parts, which has not been subjected to the process, corresponds to the rest of the process. The rest of the process is set in such a manner as to be completed within the standstill time during which the cope M1A is at a standstill at the second position B2. At the second position B2, the processing apparatus 10 completes the entire process on the cope M1A.

Figure 4:
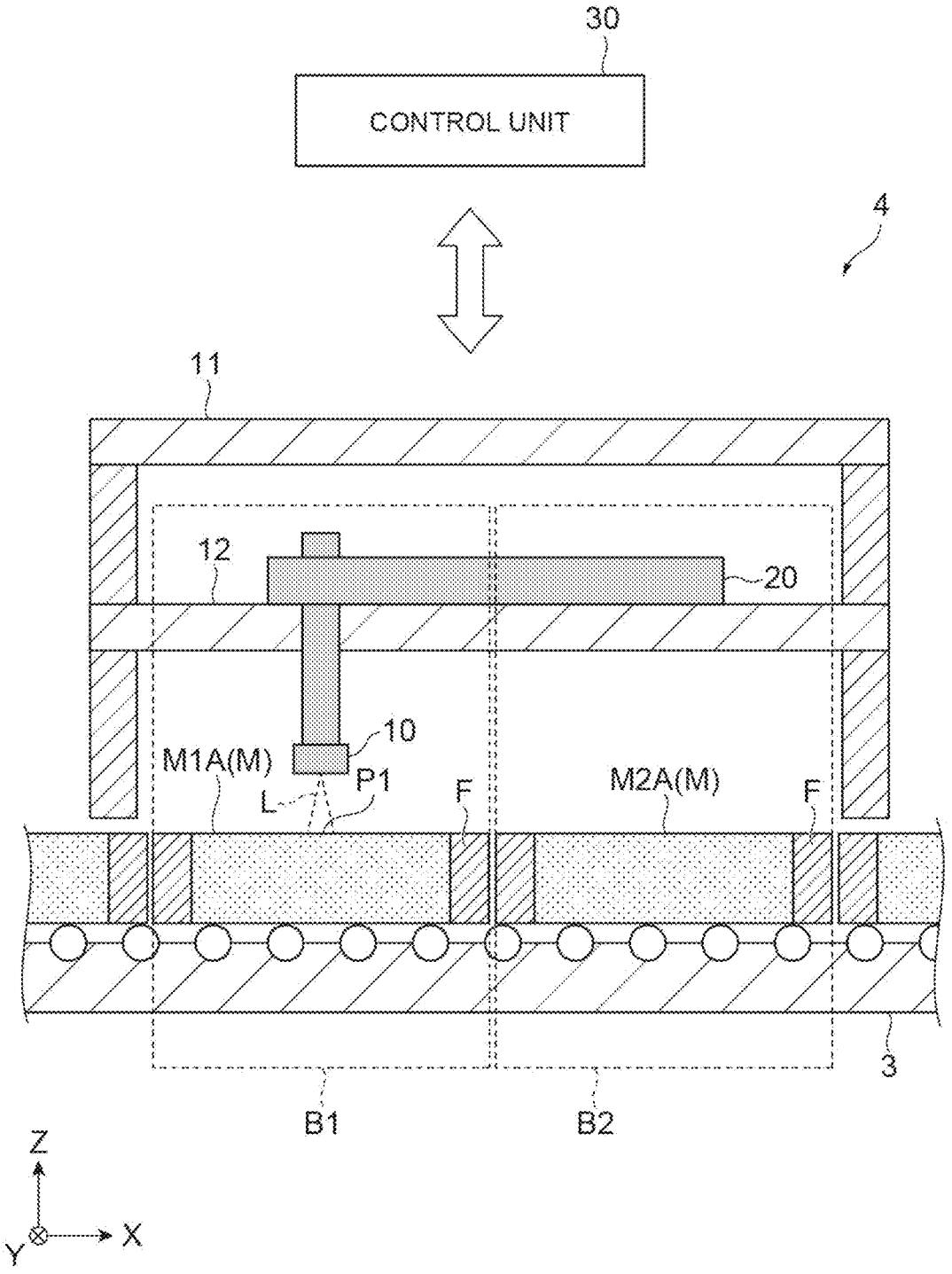
FIG. 4 is a sectional view of the mold processing system, illustrating an example in which the processing apparatus moved from the second position to the first position performs the process on the mold.

FIG. 4 is a sectional view illustrating an example in which the mold processing system conveys the processing apparatus upstream and performs the process. The control unit 30 returns the processing apparatus 10 which has completed the entire process on the cope M1A to the position corresponding to the first position B1. The conveyance line 3 simultaneously conveys the molds M on the roller conveyor by one flask. The cope M1A is conveyed downstream from the second position B2. The drag M2A which is paired with the cope M1A is conveyed from the first position B1 to the second position B2. A new cope M1A which has not been subjected to the process is conveyed from upstream to the first position B1. The control unit 30 causes the processing apparatus 10 to start the process at the timing when the new cope M1A is conveyed to the first position B1. The processing apparatus 10 performs the part of the process on the new cope M1A at the first position B1 within the standstill time.

As described above, the processing apparatus 10 reciprocates between the first position B1 and the second position B2 and repeatedly performs the process on the copes M1A of the molds M intermittently conveyed with the predetermined standstill time. The mold processing system 4 can perform the process on the mold M with a simple configuration without affecting the conveyance of the mold M.

Operation of Mold Processing System

Figure 5:
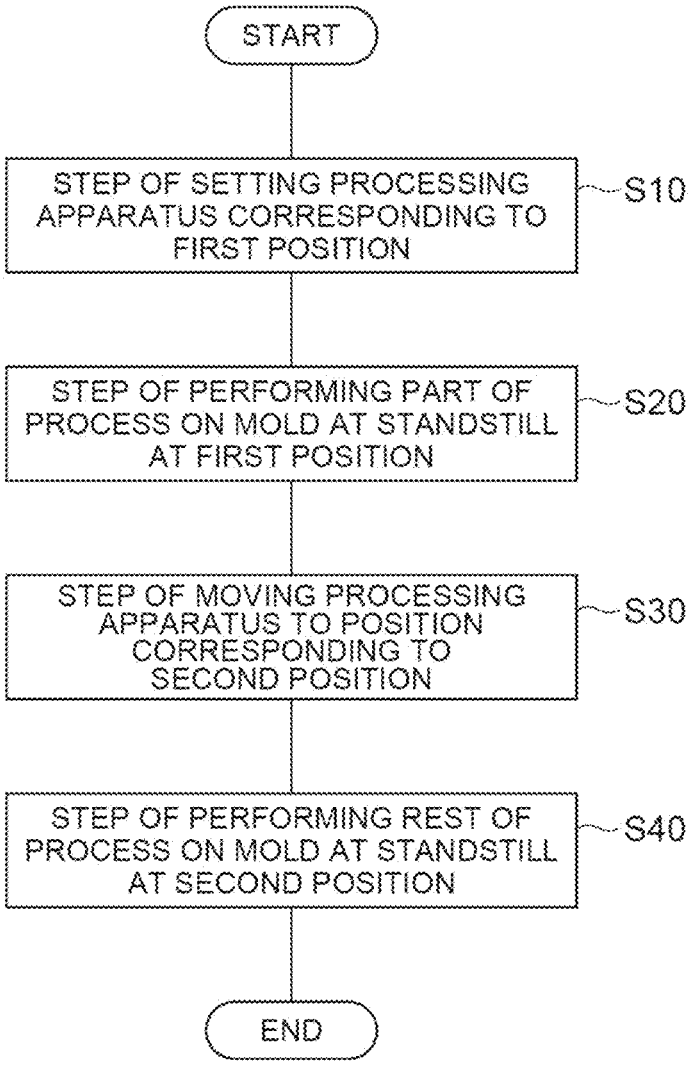
FIG. 5 is a flowchart illustrating an example of an operation of the mold processing system.

FIG. 5 is a flowchart illustrating an example of an operation of the mold processing system. The flowchart illustrated in FIG. 5 is stared, for example, in accordance with a start instruction from the operator. First, the conveyance apparatus 20 sets the processing apparatus 10 at the position corresponding to the first position B1 (step S10). The control unit 30 may control the conveyance apparatus 20 to set the processing apparatus 10 at the position corresponding to the first position B1.

Next, the processing apparatus 10 performs a part of the process on the mold M conveyed to the first position B1 within the standstill time from the timing when the mold M is conveyed to the first position B1 (step S20). The control unit 30 may control the processing apparatus 10 to cause the processing apparatus 10 to perform the part of the process within the standstill time.

Next, after completion of the part of the process, the conveyance apparatus 20 moves the processing apparatus 10 to the position corresponding to the second position B2 (step S30). The control unit 30 may control the conveyance apparatus 20 to cause the conveyance apparatus 20 to move the processing apparatus 10 to the position corresponding to the second position B2.

At last, the processing apparatus 10 performs the rest of the process on the mold M which has been subjected to the part of the process and conveyed to the second position B2 within the standstill time form the timing when the mold M which has been subjected to the part of the process is conveyed to the second position B2 (step S40). The control unit 30 may control the processing apparatus 10 to cause the processing apparatus 10 to perform the rest of the process within the standstill time.

Figure 6:
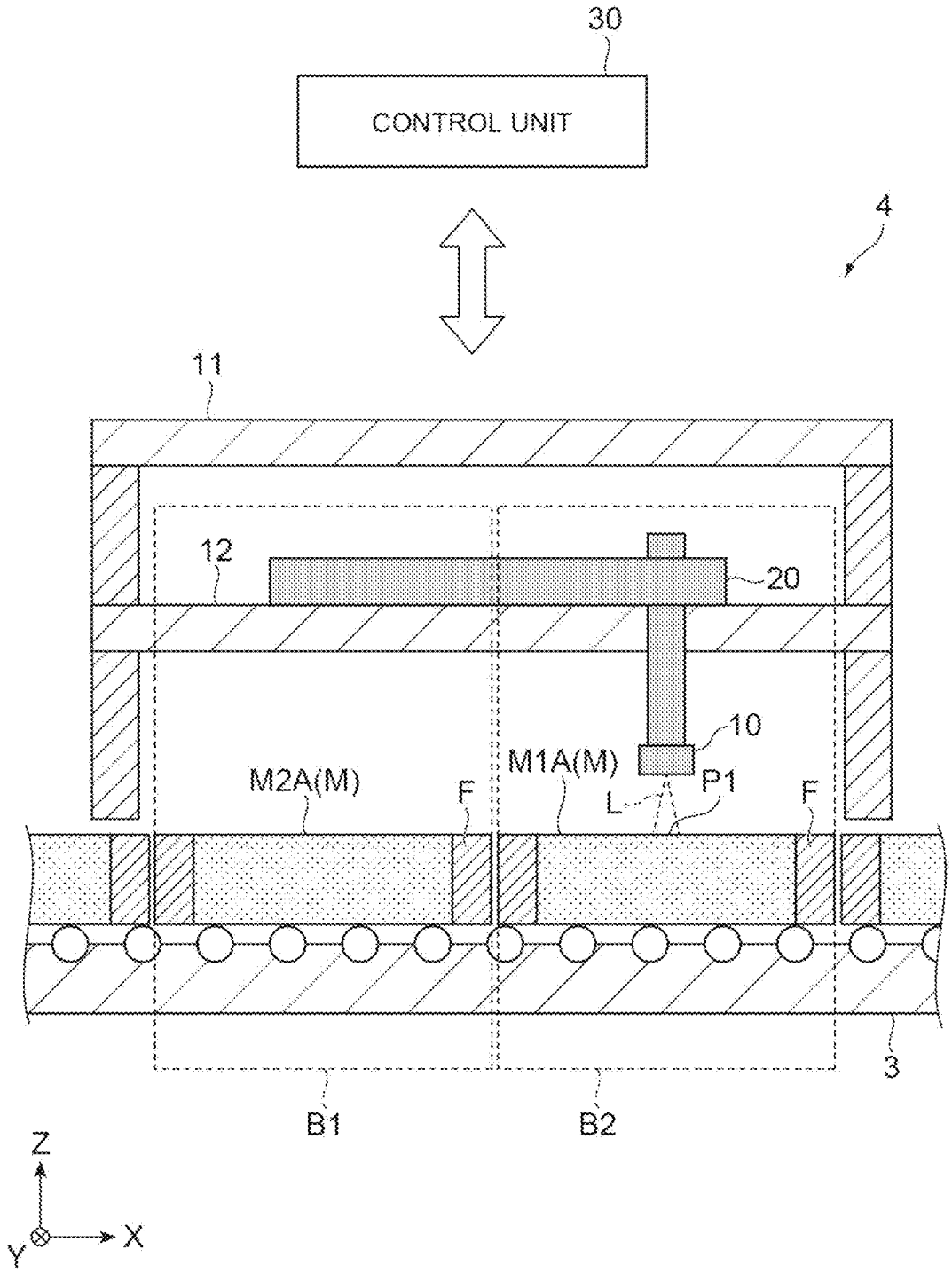
FIG. 6 is a sectional view of the mold processing system in a case where a change from a process on a cope to a process on a drag is made.
Figure 7:
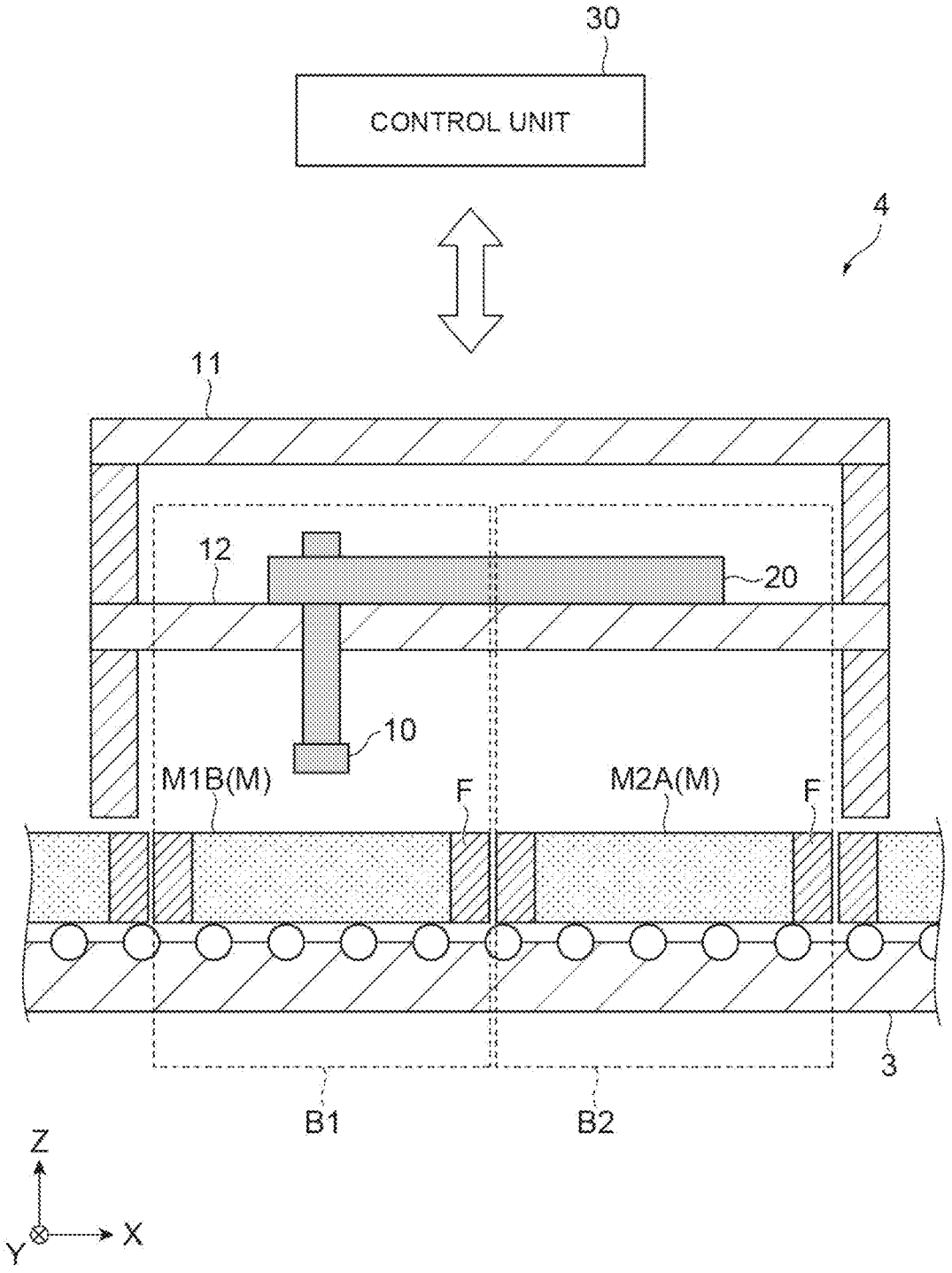
FIG. 7 is a sectional view of the mold processing system in the case where the change from the process on the cope to the process on the drag is made.
Figure 8:
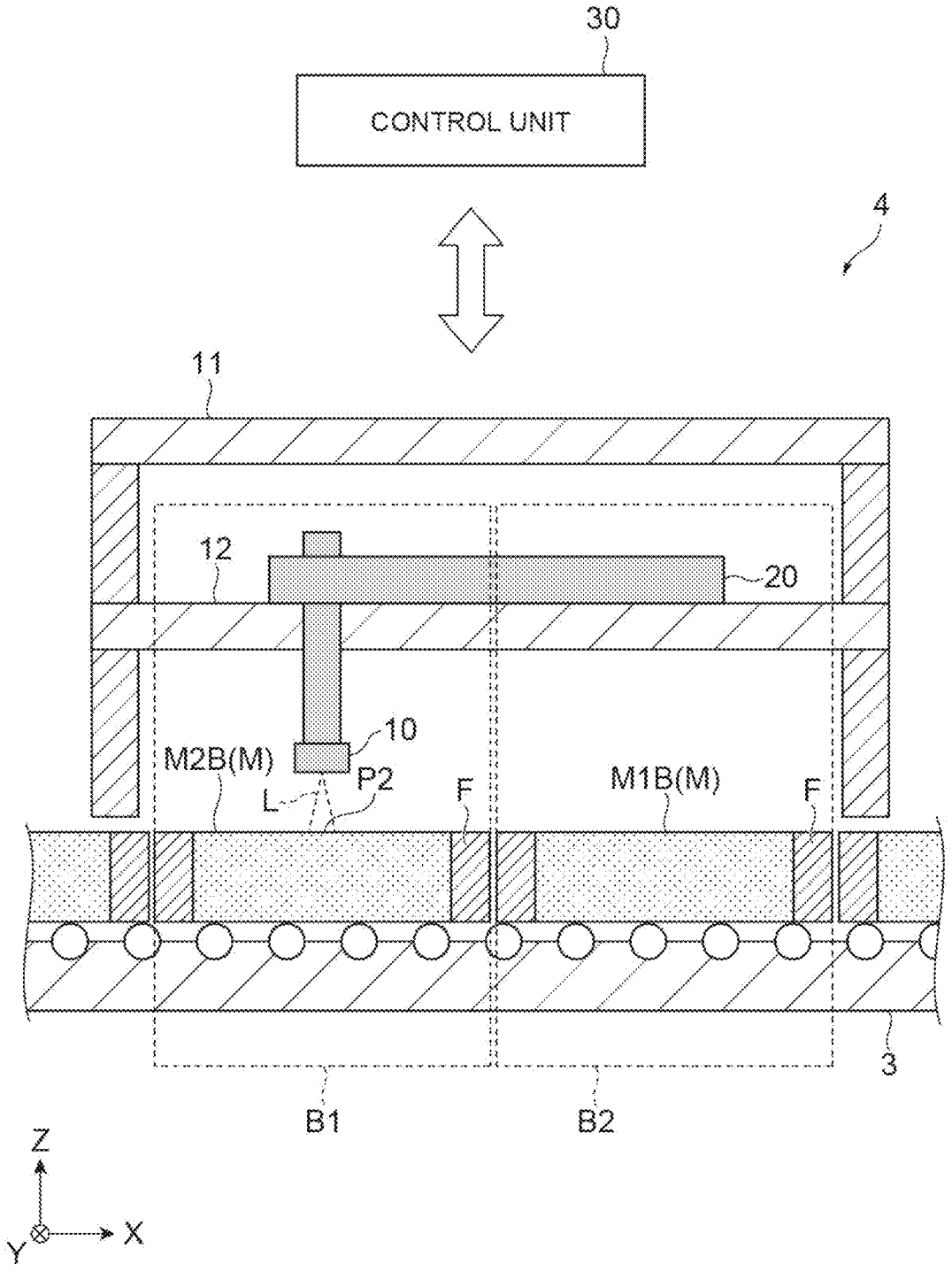
FIG. 8 is a sectional view of the mold processing system in the case where the change from the process on the cope to the process on the drag is made.

FIGS. 6 to 8 are sectional views of the mold processing system in a case where a change from a process on the cope to a process on the drag is made. The mold processing system 4 makes the change from the process on the cope to the process on the drag, for example, when the pattern is changed. For example, the combination of molds M conveyed through the conveyance line 3 is changed from a combination of a cope M1A to be subjected to the process and a drag M2A not to be subjected to the process (refer to FIG. 6) to a combination of a cope M1B not to be subjected to the process and a drag M2B to be subjected to the process (refer to FIG. 8). An intended processing position P2 (refer to FIG. 8) is set on the upper face of the drag M2B. In FIG. 6, the cope M1A to be subjected to the rest of the process is the cope M1A immediately before the change from the combination of the cope M1A and the drag M2A to the combination of the cope M1B and the drag M2B is made.

After the rest of the process is performed on the cope M1A in the state illustrated in FIG. 6, the state turns to a state illustrated in FIG. 7. In this case, the cope M1B which does not require the process is set at the first position B1. The processing apparatus 10 stands by at the position corresponding to the first position B1 without starting the process which has been performed on the cope M1A.

After the processing apparatus 10 is put on standby, the state turns to a state illustrated in FIG. 8. The control unit 30 causes the processing apparatus 10 to start a process at the timing when the drag M2B is conveyed to the first position B1. The processing apparatus 10 performs a part of the process on the drag M2B at the first position B1 within the standstill time. The control unit 30 conveys the processing apparatus 10 to the second position B2 located downstream in response to completion of the part of the process.

The conveyance line 3 simultaneously conveys the molds M on the roller conveyor by one flask after the elapse of the standstill time. The drag M2B is conveyed from the first position B1 to the second position B2. The processing apparatus 10 performs the rest of the process on the drag M2B at the second position B2 within the standstill time (not illustrated). These operations may be controlled by the line controller 6 on the basis of pattern change information of the molding machine 2. For example, a detector (not illustrated) provided on the conveyance line 3 may detect the pattern change. As described above, the processing apparatus 10 reciprocates between the first position B1 and the second position B2 and repeatedly performs the process on the drags M2B of the molds M intermittently conveyed with the predetermined standstill time.

In this manner, as illustrated in FIGS. 6 to 8, the mold processing system 4 can perform the process on the molds M without affecting conveyance of the conveyance line 3 even when the molds M not to be subjected to the process are consecutively conveyed due to pattern change.

Figure 9:
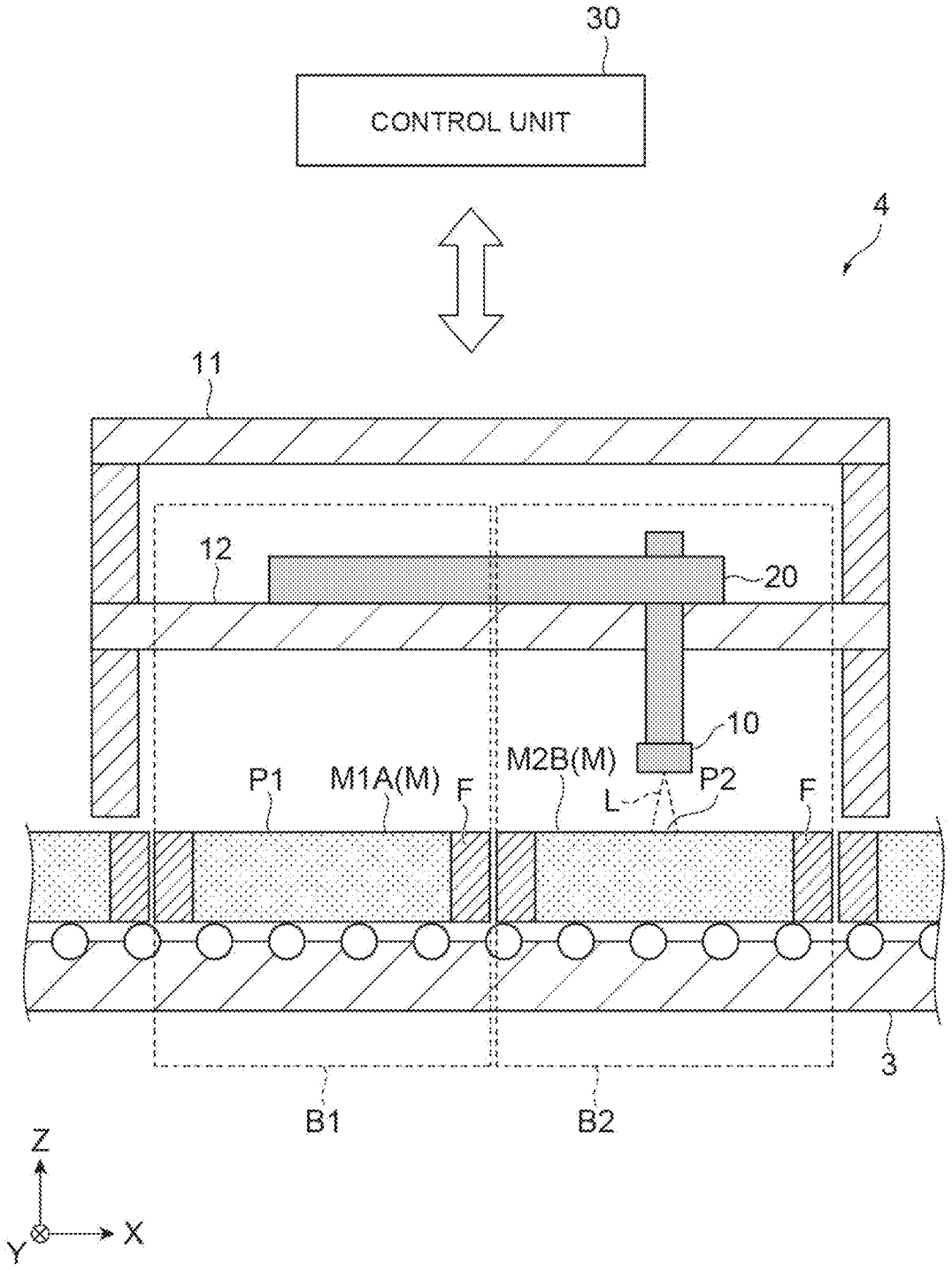
FIG. 9 is a sectional view of the mold processing system in a case where a change from the process on the drag to the process on the cope is made.
Figure 10:
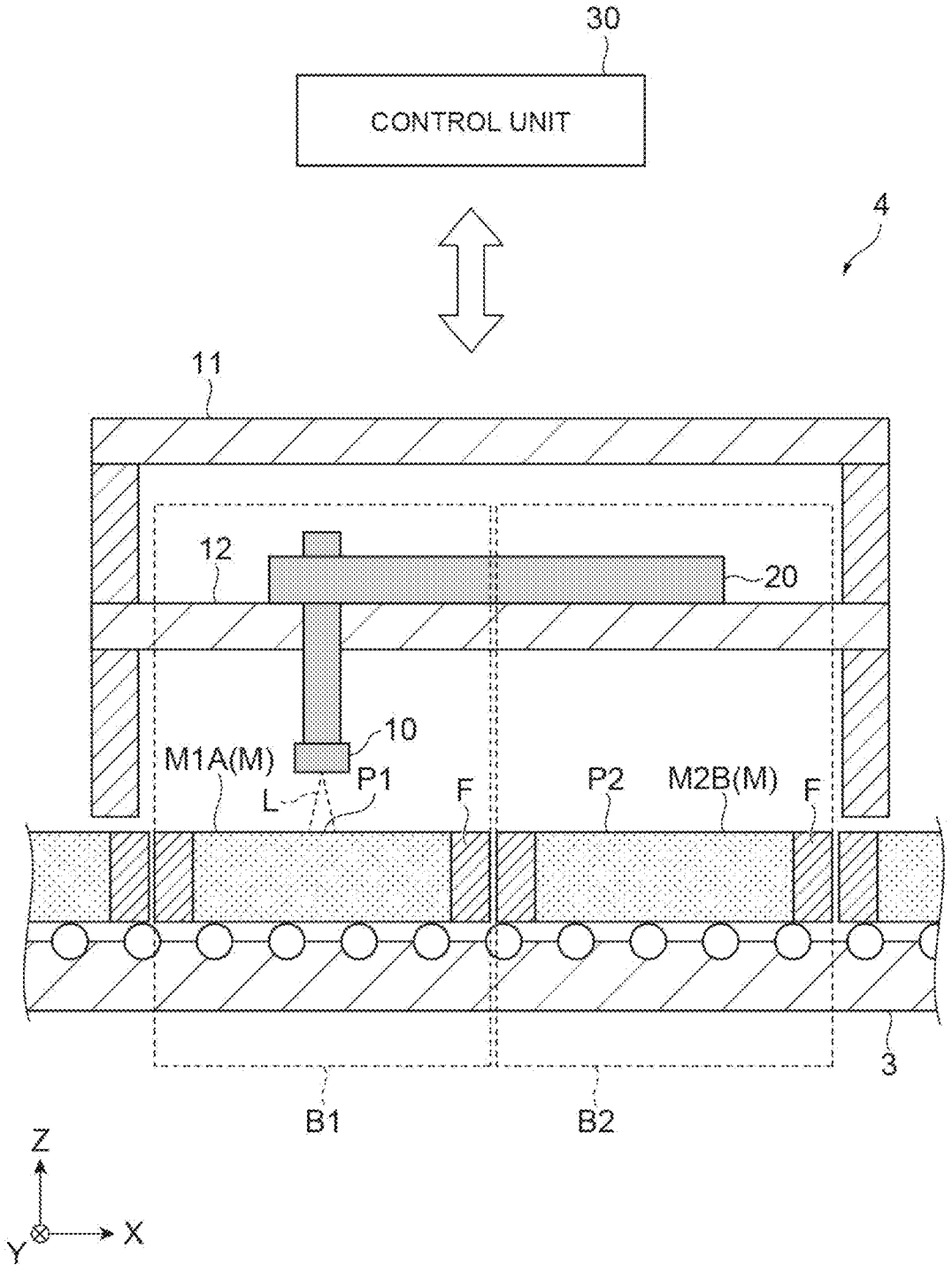
FIG. 10 is a sectional view of the mold processing system in the case where the change from the process on the drag to the process on the cope is made.

FIGS. 9 and 10 are sectional views of the mold processing system in a case where a change from a process on the drag to a process on the cope is made. The mold processing system 4 makes the change from the process on the drag to the process on the cope, for example, when the pattern is changed. As illustrated in FIG. 9, the molds M each of which requires the process are set at the first position B1 and the second position B2. For example, the drag M2B set at the second position B2 has the intended processing position P2. The cope M1A set at the first position B1 has the intended processing position P1. The drag M2B and the cope M1A are a drag and a cope which are not paired. At the second position B2, the processing apparatus 10 completes the rest of the process on the drag M2B.

Then, as illustrated in FIG. 10, the control unit 30 moves the processing apparatus 10 to the first position B1 in response to that fact that the processing apparatus 10 has completed the entire process. At this time, the conveyance line 3 does not convey the molds M arranged on the roller conveyor. The cope M1A having the intended processing position P1 stays at the first position B1. In other words, the standstill time of the molds M is extended. These operations may be controlled by the line controller 6 on the basis of pattern change information of the molding machine 2. For example, a detector (not illustrated) provided on the conveyance line 3 may detect the pattern change. The control unit 30 causes the processing apparatus 10 to start the process at the timing when the processing apparatus 10 is moved to the position corresponding to the first position B1. The processing apparatus 10 performs a part of the process on the cope M1A at the first position B1 within the extended standstill time. The control unit 30 conveys the processing apparatus 10 to the second position B2 located downstream in response to completion of the part of the process.

The conveyance line 3 simultaneously conveys the molds M on the roller conveyor by one flask after the elapse of the extended standstill time. The cope M1A is conveyed from the first position B1 to the second position B2. The processing apparatus 10 performs the rest of the process on the cope M1A at the second position B2 within the predetermined standstill time (not illustrated). As described above, after the pattern is changed, the processing apparatus 10 reciprocates between the first position B1 and the second position B2 and repeatedly performs the process on the copes M1A of the molds M intermittently conveyed with the predetermined standstill time.

In this manner, as illustrated in FIGS. 9 and 10, even when the molds M to be subjected to the process are consecutively conveyed due to the pattern change, the mold processing system 4 can perform the process on the molds M by temporarily stopping the conveyance of the conveyance line 3.

Figure 11:
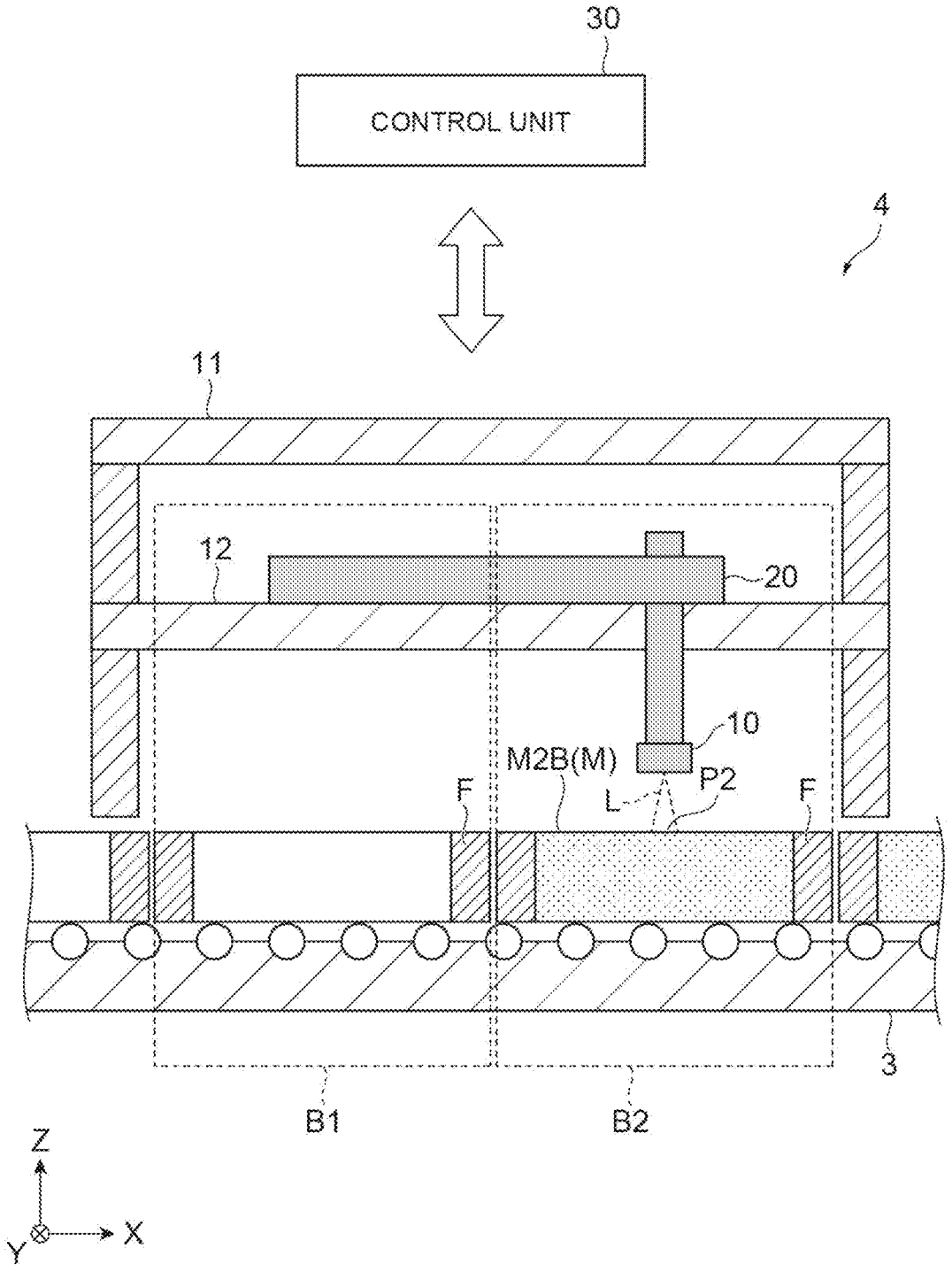
FIG. 11 is a sectional view of the mold processing system in a case where a change from a process on the drag to a process on the cope is made using an empty flask.
Figure 12:
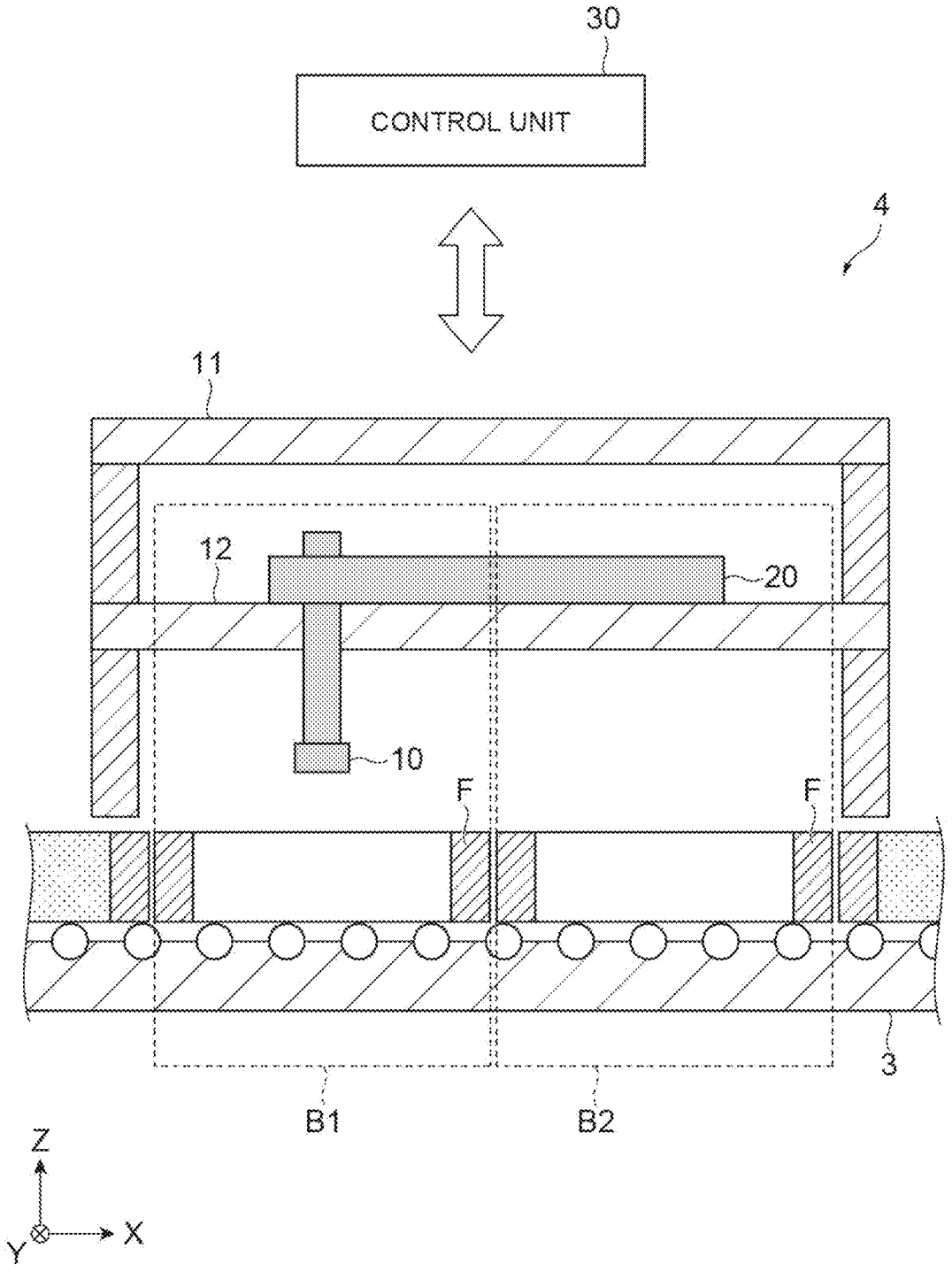
FIG. 12 is a sectional view of the mold processing system in the case where the change from the process on the drag to the process on the cope is made using the empty flask.
Figure 13:
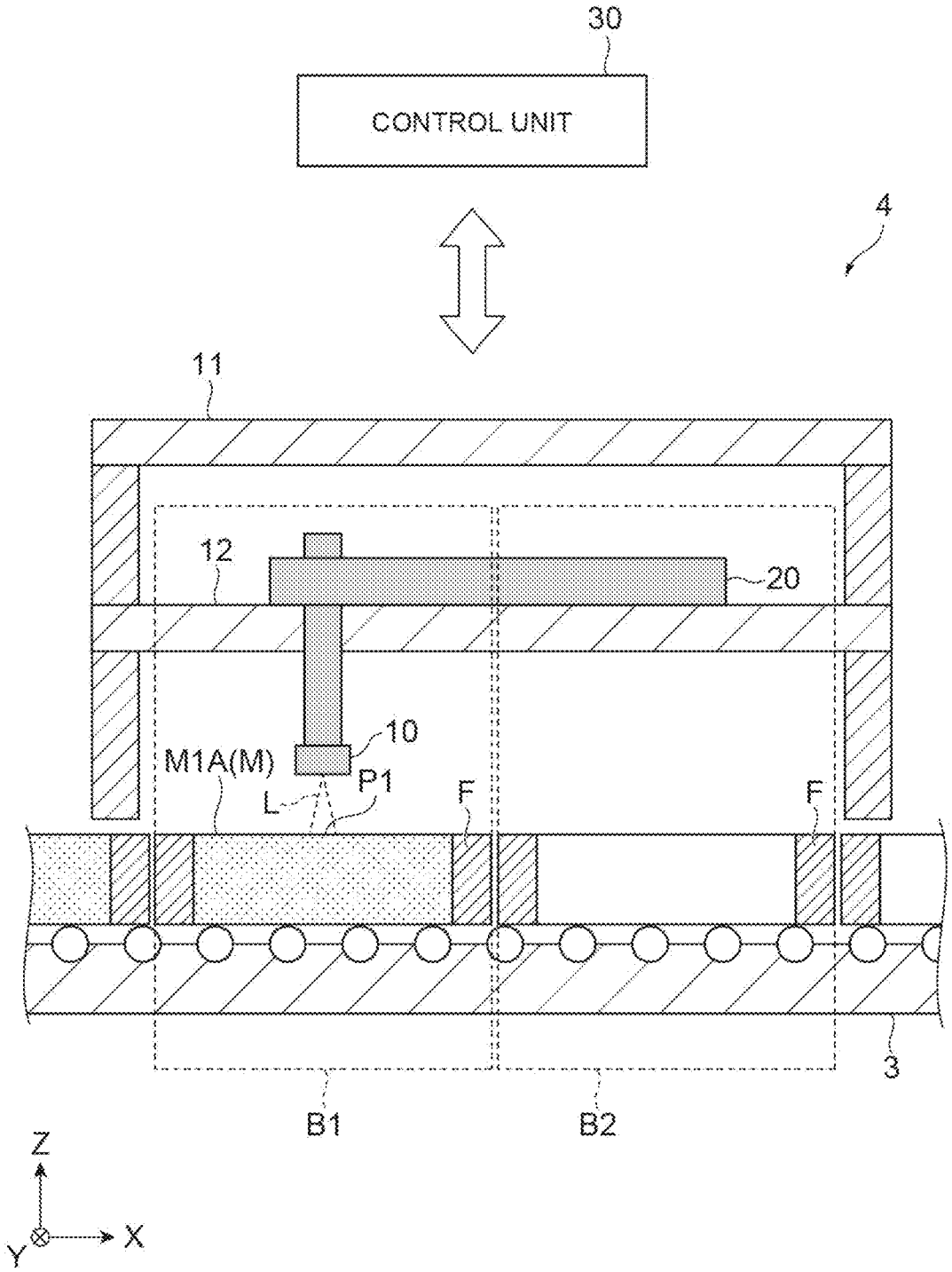
FIG. 13 is a sectional view of the mold processing system in the case where the change from the process on the drag to the process on the cope is made using the empty flask.

Hereinbelow, an example in which a change from the process on the drag to the process on the cope is made in such a manner as not to stop the conveyance of the conveyance line 3 will be described. FIGS. 11 to 13 are sectional views of the mold processing system in a case where the change from the process on the drag to the process on the cope is made using an empty flask. The empty flask indicates the molding flask F in which the mold M is not formed. For example, as illustrated in FIG. 11, the drag M2B which requires the process is set at the second position B2, whereas the mold M which requires the process is not set at the first position B1. The drag M2B set at the second position B2 has the intended processing position P2. The molding flasks F (empty flasks) are set at the first position B1 and an upstream position adjacent to the first position B1. The processing apparatus 10 completes the rest of the process on the drag M2B at the second position B2.

Next, as illustrated in FIG. 12, the conveyance line 3 simultaneously conveys the molds M and the molding flasks F on the roller conveyor by one flask. The drag M2B set at the second position B2 is conveyed downstream from the second position B2. The molding flask F set at the first position B1 is conveyed to the second position B2. The molding flask F set upstream of the first position B1 is conveyed to the first position B1. The processing apparatus 10 stands by at the position corresponding to the first position B1 without starting the process.

Then, as illustrated in FIG. 13, the conveyance line 3 simultaneously conveys the molds M and the molding flasks F on the roller conveyor by one flask. The molding flask F is conveyed downstream from the second position B2. The molding flask F set at the first position B1 is conveyed to the second position B2. The cope M1A set upstream of the first position B1 is conveyed to the first position B1. The control unit 30 causes the processing apparatus 10 to start the process at the timing when the cope M1A is conveyed to the first position B1. The processing apparatus 10 performs, at the first position, a part of the process on the cope M1A whose pattern has been changed within the standstill time. In this case, the standstill time is not extended. The control unit 30 conveys the processing apparatus 10 to the position corresponding to the second position B2 located downstream in response to completion of the part of the process.

The conveyance line 3 simultaneously conveys the molds M and the molding flasks F on the roller conveyor by one flask after the elapse of the predetermined standstill time. The cope M1A is conveyed from the first position B1 to the second position B2. The processing apparatus 10 performs the rest of the process on the cope M1A at the second position B2 within the predetermined standstill time (not illustrated). As described above, after the pattern is changed, the processing apparatus 10 reciprocates between the first position B1 and the second position B2 and repeatedly performs the process on the copes M1A of the molds M intermittently conveyed with the predetermined standstill time.

In this manner, as illustrated in FIGS. 11 to 13, the mold processing system 4 can make a change from the order having consecutive molds M to be subjected to the process to the order having consecutive molds M not to be subjected to the process by causing the conveyance line 3 to convey the empty flasks.

Summary of Embodiment

According to the mold processing system 4 and the mold processing method, the mold M is intermittently conveyed on the conveyance line 3 with the predetermined standstill time. The processing apparatus 10 which performs a process on the mold M is set by the conveyance apparatus 20 at the position corresponding to the first position B1 on the conveyance line 3 where the mold M comes to a standstill. When the mold M is conveyed to the first position B1, a part of the process is performed by the processing apparatus 10 on the mold M conveyed to the first position B1 within the standstill time from the timing when the mold M is conveyed to the first position B1. After completion of the part of the process, the processing apparatus 10 is moved by the conveyance apparatus 20 to the position corresponding to the second position B2 on the conveyance line 3 where the mold M comes to a standstill. When the mold M is conveyed to the second position B2, the rest of the process is performed by the processing apparatus 10 on the mold M which has been conveyed to the first position B1 and subjected to the part of the process within the standstill time from the timing when the mold M is conveyed to the second position B2. In this manner, the processing apparatus 10 can move together with the mold M and continuously perform the process which cannot be completed while the mold M is at a standstill at the first position B1 after the mold M is moved to the second position B2 located downstream. That is, even when the process requires a time longer than the standstill time, the mold processing system 4 can avoid extension of the standstill time by performing the process in a divided manner. Moreover, in the mold processing system 4, since the processing apparatus 10 moves together with the mold M, it is not necessary to prepare a plurality of processing apparatuses. Thus, the mold processing system 4 can perform the process on the mold M with a simple configuration without affecting the conveyance of the mold M.

Modifications

Although various explanatory embodiments have been described above, the present disclosure is not limited to the above explanatory embodiments, and various omissions, replacements, and modifications may be made.

The processing apparatus 10 may be a gas vent forming apparatus. The gas vent forming apparatus performs a drilling process for forming a gas vent hole on the mold M. The gas vent hole is a hole penetrating the mold from inside through outside. Gas generated inside the mold M after pouring is discharged to the outside of the mold M through the gas vent hole. The gas vent hole is formed using a needle or a drill included in the gas vent forming apparatus.

The conveyance apparatus 20 is not limited to an orthogonal robot such as a three-axis robot. The conveyance apparatus 20 may be, for example, a multi-axis robot, such as a multi-articulated robot, a SCARA robot, or a parallel-link robot.

Figure 14:
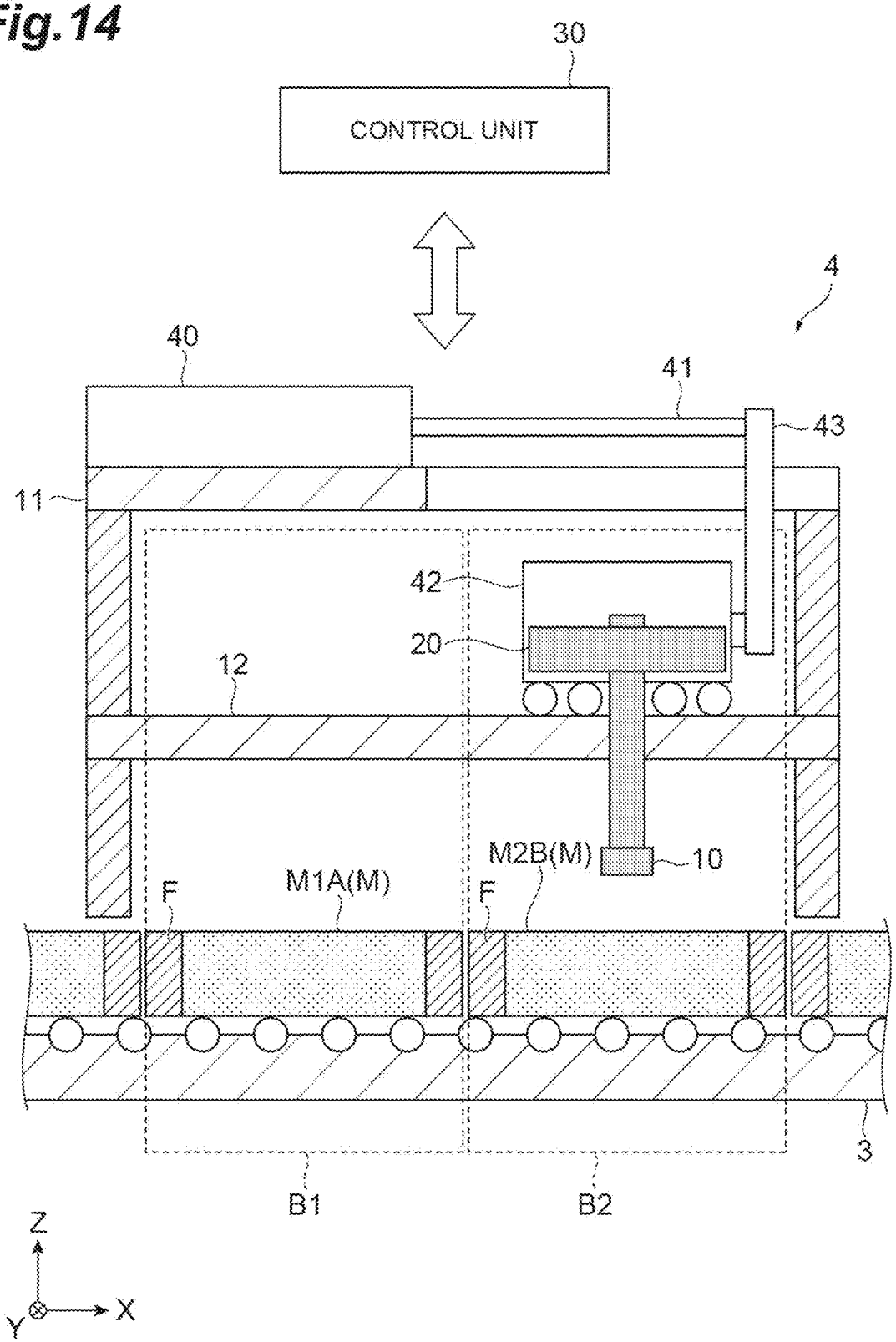
FIG. 14 is a sectional view of the mold processing system in a case where the processing apparatus and a conveyance apparatus are moved by another conveyance means.

The processing apparatus 10 and the conveyance apparatus 20 may be integrally moved by another conveyance means. FIG. 14 is a sectional view of the mold processing system 4 in a case where the processing apparatus 10 and the conveyance apparatus 20 are moved by another conveyance means. The other conveyance means illustrated in FIG. 14 is, for example, a carriage apparatus 40. The carriage apparatus 40 includes an extendable unit 41, a carriage unit 42, and a connection member 43. The three-axis robot as an example of the conveyance apparatus 20 is placed on the carriage unit 42. The extendable unit 41 which extends and contracts in the X-axis direction moves the carriage unit 42 which is connected to the extendable unit 41 through the connection member 43. The extendable unit 41 includes, for example, a cylinder mechanism (hydraulic, pneumatic, or electric) or a rack-and-pinion mechanism. In this case, the processing apparatus 10 and the conveyance apparatus 20 are integrally moved by the carriage apparatus 40 between the first position B1 and the second position B2.

The mold M is not limited to the mold with the molding flask F and may be, for example, a flaskless mold, a self-hardening mold, a core, or a core set in the mold M.

The conveyance line 3 may not alternately convey the molds M which require the process and the molds M which do not require the process. For example, the conveyance line 3 may intermittently convey the molds M which require the process at required intervals. The control unit 30 may not control the conveyance apparatus 20 to move the processing apparatus 10 to the first position B1 after completion of the rest of the process.

The number of positions where the mold M comes to a standstill on the conveyance line 3 may be three or more. For example, the position where the mold M comes to a standstill on the conveyance line 3 may include a third position. The number of positions to which the processing apparatus 10 is conveyed may be three or more. The processing apparatus 10 may move across three or more positions. For example, the processing apparatus 10 may be moved to a position corresponding to the third position.

When the mold M on which the entire process can be performed within the predetermined standstill time is conveyed, the processing apparatus 10 may not be moved. Moreover, when the molds M on each of which the entire process can be performed within the predetermined standstill time are consecutively conveyed, the empty flask may not be conveyed.

The mold processing system 4 may make a change from the order having consecutive molds M to be subjected to the process to the order having consecutive molds M not to be subjected to the process by causing the conveyance line 3 to convey a disposable flask. The disposable flask indicates a mold M not to be subjected to the process performed after molding.

The above embodiment describes, as an example of the casting system 1, the cope-preceding casting system 1 which forms the drag M2B after forming the cope M1A and repeatedly performs molding and conveyance in the order from the cope to the drag. Alternatively, as a modification, the casting system 1 may be a drag-preceding casting system 1 which forms the cope M1A after forming the drag M2B and repeatedly performs molding and conveyance in the order from the drag to the cope.

The mold processing system 4 may include a positioning unit which mechanically fixes the mold M at a predetermined operation position. The positioning unit is disposed at at least one of the first position B1 and the second position B2. For example, the positioning unit includes a pin. The pin is a wedge member which moves back and forth in a direction perpendicular to the traveling direction of the mold M. The pin has a shape tapered toward the tip thereof. A hole which is engageable with the pin is provided on the molding flask F. The diameter of the hole is slightly larger than the diameter of the pin. The hole has an inner face whose diameter gradually decreases toward the bottom thereof. When the mold M is carried into the predetermined operation position, the pin is inserted into the hole. The mold M on the conveyance line 3 is accurately fixed at the predetermined operation position by the engagement between the pin and the inner face of the hole. The control unit 30 may cause the processing apparatus 10 to start the process in response to that the mold M has been fixed.

REFERENCE SIGNS LIST

1 . . . casting system, 2 . . . molding machine, 3 . . . conveyance line, 4 . . . mold processing system, 5 . . . pouring machine, 6 . . . line controller, M . . . mold, F . . . molding flask, 10 . . . processing apparatus, 20 . . . conveyance apparatus, 30 . . . control unit, B1 . . . first position, B2 . . . second position.

What is claimed is:

1. A mold processing system comprising:

a conveyance line intermittently configured to convey a mold with a predetermined standstill time;

a processing apparatus configured to perform a process on the mold on the conveyance line;

a conveyance apparatus configured to convey the processing apparatus along the conveyance line; and a control unit configured to control the processing apparatus and the conveyance apparatus, wherein the control unit controls the conveyance apparatus to set the processing apparatus at a position corresponding to a first position on the conveyance line and controls the processing apparatus to perform a part of the process on the mold conveyed to the first position within a period from timing when the mold is conveyed to the first position until the standstill time has elapsed, and controls, after completion of the part of the process, the conveyance apparatus to move the processing apparatus to a position corresponding to a second position downstream of the first position on the conveyance line and controls the processing apparatus to perform a rest of the process on the mold subjected to the part of the process and conveyed to the second position within a period from timing when the mold subjected to the part of the process is conveyed to the second position until the standstill time has elapsed.

2. The mold processing system according to claim 1, wherein the processing apparatus is a marking apparatus marking an identifier on the mold.

3. The mold processing system according to claim 2, wherein the first position and the second position are adjacent to each other, the conveyance line conveys a plurality of molds, the plurality of molds include a first mold to be subjected to the process and a second mold not to be subjected to the process, the conveyance line alternately and sequentially conveys the first mold and the second mold, and the control unit controls, after completion of the rest of the process on the first mold, the conveyance line to return the processing apparatus to the position corresponding to the first position to perform the part of the process on the first mold conveyed to the first position next.

4. The mold processing system according to claim 1, wherein the processing apparatus is a gas vent forming apparatus forming a gas vent hole on the mold.

5. The mold processing system according to claim 4, wherein the first position and the second position are adjacent to each other, the conveyance line conveys a plurality of molds, the plurality of molds include a first mold to be subjected to the process and a second mold not to be subjected to the process, the conveyance line alternately and sequentially conveys the first mold and the second mold, and the control unit controls, after completion of the rest of the process on the first mold, the conveyance line to return the processing apparatus to the position corresponding to the first position to perform the part of the process on the first mold conveyed to the first position next.

6. The mold processing system according to claim 1, wherein the first position and the second position are adjacent to each other, the conveyance line conveys a plurality of molds, the plurality of molds include a first mold to be subjected to the process and a second mold not to be subjected to the process, the conveyance line alternately and sequentially conveys the first mold and the second mold, and the control unit controls, after completion of the rest of the process on the first mold, the conveyance line to return the processing apparatus to the position corresponding to the first position to perform the part of the process on the first mold conveyed to the first position next.

7. A mold processing method performed by a mold processing system, the mold processing system including:

a conveyance line intermittently conveying a mold with a predetermined standstill time;

a processing apparatus performing a process on the mold on the conveyance line; and a conveyance apparatus conveying the processing apparatus along the conveyance line, the mold processing method comprising:

a step of setting, by the conveyance apparatus, the processing apparatus at a position corresponding to a first position on the conveyance line;

a step of performing, by the processing apparatus, a part of the process on the mold conveyed to the first position within a period from timing when the mold is conveyed to the first position until the standstill time has elapsed;

a step of moving, by the conveyance apparatus, the processing apparatus to a position corresponding to a second position downstream of the first position on the conveyance line after completion of the part of the process; and a step of performing, by the processing apparatus, a rest of the process on the mold subjected to the part of the process and conveyed to the second position within a period from timing when the mold subjected to the part of the process is conveyed to the second position until the standstill time has elapsed.

* * * * *